United States Patent [19]

Staufer

[11] 4,180,265

[45] Dec. 25, 1979

[54] IMPLEMENT FOR STRIKING A BALL

[75] Inventor: Adolf Staufer, Ried im Innkreis, Austria

[73] Assignee: Fischer Gesellschaft m.b.H., Ried, Austria

[21] Appl. No.: 816,032

[22] Filed: Jul. 15, 1977

[30] Foreign Application Priority Data

Mar. 31, 1977 [AT] Austria ..... 2263/77

[51] Int. Cl.[2] ..... A63B 51/00

[52] U.S. Cl. ..... 273/73 D

[58] Field of Search ..... 273/73 R, 73 C, 73 D, 273/73 F, 73 G, 73 H; 84/217, 218, 234, 235, 287, 288, 310

[56] References Cited

U.S. PATENT DOCUMENTS

| | | | |
|---|---|---|---|
| 1,526,734 | 2/1925 | Andrews et al. | 273/73 D |
| 2,528,239 | 10/1950 | McVay | 16/110 R X |
| 2,732,209 | 1/1956 | Forbes | 273/73 R |
| 3,941,380 | 3/1976 | Lacoste | 273/73 R |

FOREIGN PATENT DOCUMENTS

| | | | |
|---|---|---|---|
| 332270 | 9/1976 | Austria | 273/73 D |
| 463997 | 8/1928 | Fed. Rep. of Germany | 273/73 D |
| 2501659 | 7/1976 | Fed. Rep. of Germany | 273/73 D |
| 715356 | 9/1931 | France | 273/73 D |
| 786619 | 6/1935 | France | 273/73 D |
| 1398833 | 4/1965 | France | 273/73 D |
| 20158 | of 1899 | United Kingdom | 273/73 D |
| 267837 | 3/1927 | United Kingdom | 273/73 D |
| 331925 | 7/1930 | United Kingdom | 273/73 D |
| 547946 | 9/1942 | United Kingdom | 273/73 D |

*Primary Examiner*—Richard J. Apley
*Attorney, Agent, or Firm*—Fleit & Jacobson

[57] ABSTRACT

This invention relates to means for suppressing vibration in implements which serve to strike the ball and comprise a striking surface, a hoop which encloses the striking surface, and a handle. The invention relates particularly to tennis rackets and aims at suppressing the high-frequency vibration which is excited by the impact of the ball.

In these striking implements, at least two longitudinal or transverse strings or at least one longitudinal string and at least one transverse string are mechanically coupled to each other by a vibration absorber.

11 Claims, 4 Drawing Figures

IMPLEMENT FOR STRIKING A BALL

BACKGROUND

Figure 1:
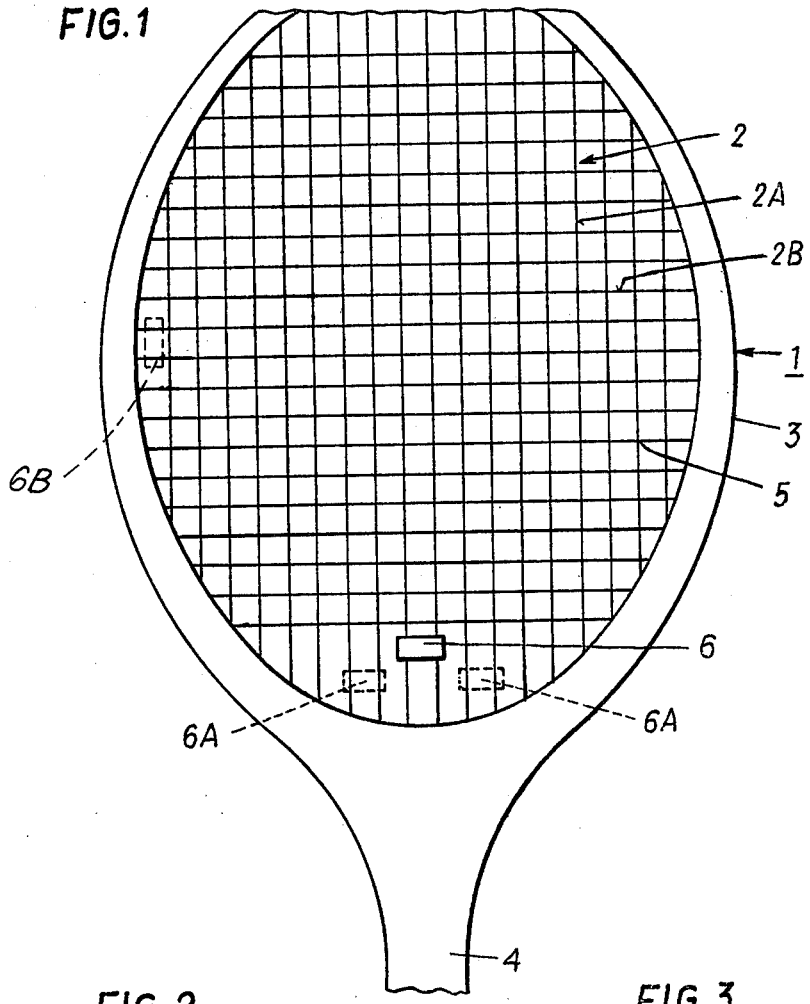

It is known that vibration is excited in a ball-striking implement as it strikes the ball and that such vibration is felt by the player in his hand and may be heard by him as sound vibration. Because it is believed that the vibration damages the hand-arm system, great attention is paid in the design of tennis rackets to the damping of such vibration. Almost all these damping measures concern the implement itself because it is in direct contact with the hand and can transmit vibration thereto. It is believed that the structural material of the implement is of high significance. For instance, it is often believed that wood is superior in damping properties than metal and glass fiber-reinforced plastics material. In the recent pertinent literature, the alleged improvements in the damping performance which are due to the use of novel fibrous materials, such as carbon fibers or boron fibers, have beem emphasized. It has also often been stated that the vibratory behavior of the racket can be influenced by the distribution of its stiffness. Besides, it has been suggested to influence the vibration by vibration-absorbing elements which are incorporated in or attached to the racket. The design of the handle as a vibration absorber is known in the art as well as the provision of spring elements connected between the strings and the hoop or between the hoop and the shaft.

It has also been stated that the vibratory behavior is influenced by the strings, and it is generally believed that in tennis rackets strings made from natural catgut have a lower tendency to vibrate than strings of plastics material. On the other hand, the choice of materials is highly restricted by the requirement for a diaphragm-like flexibility, which matches the ball. For this reason it has been virtually impossible so far to control the vibration by a change of the string material. It is also known that a variation of the initial tension of the strings influences the vibratory behavior within certain limits, and lower initial tensions are said to reduce the tendency to vibrate.

It is an object of the present invention to teach how vibration, particularly in the range above 300 Hz, can be controlled much more effectively than with the known means. This object can be accomplished in that at least two longitudinal or two transverse strings or at least one longitudinal string and one transverse string of the strings forming the striking surface are mechanically coupled to one another by means of a vibration absorber.

Vibration in that frequency range is unpleasantly felt in the hand and is audible and has been found to be generated by resonant vibration of the strings, from which the vibration is transmitted to the hoop at the points where the strings are fixed to the hoop. Whereas the resonance peak is very sharp so that the energy content of the vibration is very small, even the provision of highly effective damping means on the hoop has surprisingly failed to reduce the subjective impression of the vibration. This is due to the fact that the strings are fixed appoximately along a nodal line, and damping means attached in accordance with theory are ineffective in said nodal line. For the same reason, the players hand cannot cause the resonant vibration of the string to decay at the handle within a time which is shorter than the time threshold of perception, which amounts to about 0.1 second, although the hand has an excellent damping capacity.

On the other hand, such vibration can be absorbed in accordance with the invention in that two or more individual ones of the strings forming the striking surface are mechanically coupled to each other by a suitable coupling element. Coupling may be effected by spring and/or mass elements. The coupling elements may preferably consist of an elastomeric material which has a visocelastic inherent damping properties. The vibration of the diaphragm is damped as result of the fact that the elastomerically coupled strings are detuned relative to each other and as a result of the viscoelastic damping in the coupling element. Different coupling elements may be used which have such a spring constant and/or coupling coefficient that they cause the coupled strings to be detuned relative to each other.

Further details of the measures taught by the invention will be explained more fully with reference to the drawings, which show illustrative embodiments of the present invention.

Figure 2:
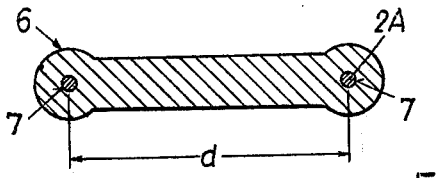
Figure 3:
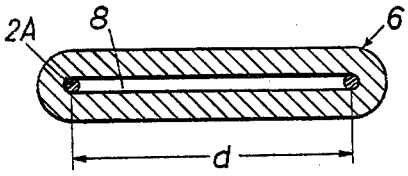
Figure 4:
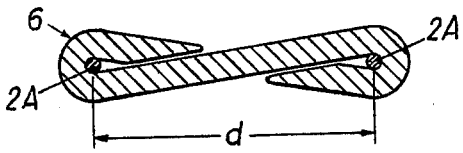

FIG. 1 shows the string pattern of an implement for striking a ball and indicates various locations of the vibration absorber, and FIGS. 2 to 4 are transverse sectional views showing different embodiments of the absorber.

The racket 1 shown in FIG. 1 comprises strings 2 which are held by a hoop 3 and also comprises a shaft 4, which serves as a handle. The strings 2 comprise longitudinal or main strings 2A and transverse strings 2B, which are interwoven with the main strings 2A like the filling threads of a woven fabric. Owing to the initial tension of the main strings and transverse strings and the friction at the crossings, 5 the strings 2 act like a planar diaphragm, which can perform vibration with a nodal line disposed at the edge and at a natural frequency which depends on the initial tension of the strings. One embodiment of the vibration absorber according to the invention comprises an elastomeric viscoelastic coupling element 6, which is connected between the two middle main strings at that end of the striking surface which is near the heart and specifically between portions of said strings which are not coupled by transverse strings. The coupling element 6 is designed to establish a force-transmitting connection to each of the strings which are to be coupled.

Such coupling element is shown in a transverse sectional view in FIG. 2, from which it is apparent that during the application of the strings to the racket two longitudinal strings 2A of the racket have been threaded through bores 7 which are formed in the elastomeric viscoelastic coupling element and spaced apart by a distance d.

The coupling element 6 shown in a transverse sectional view in FIG. 3 has a slot 8, which has a length d and through which the desired adjacent strings 2A have been threaded during the application of the strings to the racket.

FIG. 4 is a transverse sectional view showing a coupling element 6 which can be subsequently fitted on previously strung racket. The distance d should be selected so that the strings to be coupled are slightly urged toward each other owing to the elasticity of the coupling element, i.e., the distance d should be somewhat larger or preferably smaller than the normal spacing of the strings.

It is also possible to use other coupling elements, which can be fitted on or clamped to the strings of the racket. The desired vibration-absorbing effect will also be obtained when more than two strings are coupled by a single coupling element 6. The length of the coupling element 6 may be selected as desired in consideration of the cross-section and modulus of shear and is preferably between 2 mm and 20 mm.

Whereas the vibration-absorbing coupling element is preferably connected to the centrally disposed main strings, equivalent results can be produced by a coupling of any other longitudinal and transverse strings, for instance, FIG. 1 illustrates a coupling element 6B interconnecting two transverse strings. Provided that the coupling element is positioned near the vibration antinode of one of the coupled strings. This can be checked acoustically or by touching with the hand when the strings are struck.

A particularly strong damping will be effected when the strings of two or more pairs rather than those of a single pair are interconnected by respective coupled elements. An illustrative embodiment is respresented in dotted lines in FIG. 1 by a pair of coupling elements 6A. The vibration-absorbing effect will also be augmented by the fixation of a plurality of mutually independent coupling elements to strings of the same pair. Whereas the embodiments described by way of example comprise coupling elements consisting of elastomeric material and having viscoelastic inherent damping properties, spring elements made of other synthetic or natural materials and having suitable coupling coefficients may be used, such as coil springs, spiral springs or other suitable elements.

In all embodiments, the damping effect can be varied in that the viscoelastic elastomeric coupling element is shifted along the coupled strings.

It will be understood that different absorbers may be used within the scope of the invention to couple longitudinal and/or transverse strings of the racket in any desired number and at any desired points. For instance, the absorbers may be provided in the central areas or at other locations of the striking surface formed by the string. To ensure a reliable fixation, those parts of the coupling element which enclose the strings may be adhesively joined to each other and to the strings. Finally, it is possible to use damping elements which effect a liquid or frictional damping.

What is claimed is:

1. An implement for striking a ball, comprising a handle, a head member connected to the handle and defining a hoop having sides, and a striking surface enclosed by said hoop and constituted by parallel longitudinal strings and parallel transverse strings, the longitudinal and transverse strings intersecting in a region spaced from the sides of the hoop, and preformed vibration-absorbing means insertable between two parallel strings for mechanically interlocking at least two of said parallel strings in a region between the intersecting strings and the sides of the hoop, the vibration absorbing means being spaced from the sides of the hoop.

2. An implement as set forth in claim 1, characterized in that at least tow longitudinal strings are mechanically interlocked to each other by said vibration-absorbing means.

3. An implement as set forth in claim 1, characterized in that at least two transverse strings are mechanically interlocked to each other by said vibration-absorbing means.

4. An implement as set forth in claim 1, characterized in that said vibration-absorbing means comprises an elastomeric material having viscoelastic inherent damping properties.

5. An implement as set forth in claim 1, characterised in that said vibration-absorbing means include means defining spaced openings adapted to have at least two strings threaded therethrough and the largest distance between said strings in said spaced openings is smaller than the normal distance between said two strings.

6. An implement as set forth in claim 1, characterized in that said vibration-absorbing means comprises a metallic spring element.

7. An implement as set forth in claim 1, characterized in that said vibration-absorbing means comprises an inelastic element.

8. An implement as set forth in claim 1, characterized in that said vibration-absorbing means comprises a spring element consisting of an inelastic elastomeric synthetic material.

9. An implement as set forth in claim 1, characterised in that less than five parallel strings are mechanically interlocked by said vibration-absorbing means.

10. An implement as set forth in claim 1, characterised in that said vibration-absorbing means comprises a plurality of separate, spaced-apart elements, each of said elements mechanically interlocking less than five parallel strings.

11. An implement as set forth in claim 10 wherein each of said elements mechanically interlocks two parallel strings.

* * * * *